US008422718B2

(12) United States Patent
Santiago

(10) Patent No.: US 8,422,718 B2
(45) Date of Patent: Apr. 16, 2013

(54) SOFT-OPENING HINGE AND HEADPHONE SET INCLUDING SAME

(75) Inventor: Ronaldo J. Santiago, South Elgin, IL (US)

(73) Assignee: Koss Corporation, Milwaukee, WI (US)

( * ) Notice: Subject to any disclaimer, the term of this patent is extended or adjusted under 35 U.S.C. 154(b) by 0 days.

(21) Appl. No.: 13/241,325

(22) Filed: Sep. 23, 2011

(65) Prior Publication Data

US 2012/0014554 A1 Jan. 19, 2012

Related U.S. Application Data

(62) Division of application No. 12/997,984, filed as application No. PCT/US2009/048256 on Jun. 23, 2009, now Pat. No. 8,055, 006.

(60) Provisional application No. 61/074,717, filed on Jun. 23, 2008.

(51) Int. Cl.
*H04R 25/00* (2006.01)

(52) U.S. Cl.
USPC ..... 381/379; 381/370; 381/374

(58) Field of Classification Search ..... 381/370–374, 381/376, 378–384
See application file for complete search history.

(56) References Cited

U.S. PATENT DOCUMENTS

| | | | |
|---|---|---|---|
| 3,430,261 | A | 3/1969 | Benner |
| 4,404,434 | A | 9/1983 | Pelt et al. |
| 4,445,005 | A | 4/1984 | Furuhashi |
| 5,293,647 | A | 3/1994 | Mirmilshteyn et al. |
| 5,369,857 | A | 12/1994 | Sacherman et al. |
| 6,377,697 | B1 | 4/2002 | Cheng |
| 6,993,143 | B2 | 1/2006 | Harris et al. |
| 7,580,539 | B2 | 8/2009 | Tachikawa |
| 2001/0032375 | A1 | 10/2001 | Patterson et al. |
| 2005/0053255 | A1 | 3/2005 | Harris et al. |
| 2008/0146295 | A1 | 6/2008 | Jorgensen et al. |

OTHER PUBLICATIONS

International Search Report for International Application No. PCT/US2009/048256 dated Oct. 9, 2009, 3 pages.

Written Opinion of the International Searching Authority for International Application No. PCT/US2009/048256 dated Oct. 9, 2009, 7 pages.

International Preliminary Report on Patentability International No. PCT/US09/48256 dated Apr. 23, 2010, 10 pages.

*Primary Examiner* — Suhan Ni
(74) *Attorney, Agent, or Firm* — K&L Gates LLP

(57) ABSTRACT

A foldable headphone set in which the earphones of the headphone set may rotate between a folded (or closed) position and an unfolded (or open) position due to a torsion- or spring-loaded hinge associated with each earphone. The headphone set may be held in the folded position by way of a magnetic latch. Also, the user may adjust the amount of rotation by the respective hinges so that the earphones rotate to the user-defined limit position. The user could set the user-defined limit position to a comfortable position for the user. That way, the earphones will unfold to the user-defined limit position every time (until the user-defined limit is readjusted). In addition, a friction grommet in the hinge may provide for a slow, controlled, smooth opening of the hinge. In at least one embodiment, a hinge is provided for use in a variety of applications.

11 Claims, 10 Drawing Sheets

SOFT-OPENING HINGE AND HEADPHONE SET INCLUDING SAME

PRIORITY CLAIM

The present application is (i) a divisional of U.S. patent application Ser. No. 12/997,984, filed Feb. 16, 2011, which U.S. patent application claims priority to (ii) PCT application No. PCT/US09/48256, filed Jun. 23, 2009, which PCT application claims the benefit of (iii) U.S. provisional application Ser. No. 61/074,717, filed Jun. 23, 2008.

BACKGROUND

The present invention relates generally to a headphone set and, in particular, headphone sets with a foldable headband between two earpieces. Headphone sets with foldable headbands are known. For example, U.S. Pat. No. 6,993,143 discloses a headband with four hinges (two per each side of the headband) and published U.S. patent application Pub. No. 2005/0244027 discloses a headband with two hinges (one per each side of the headband).

SUMMARY

In various embodiments, a headphone unit is provided. In at least one embodiment, the headphone unit can comprise a foldable headband and at least one earpiece connected to the foldable headband. In these embodiments, the foldable headband can include a first arm, a second arm, a hinge connecting the first arm to the second arm, and a magnetic latch operably coupled to the first arm. Additionally, in these embodiments, the first arm and the second arm are rotatable between a first angle and a second angle defined between the first arm and the second arm. Further, in these embodiments, the hinge can comprise an adjustment member configured to adjust the second angle and a torsional member. Additionally, in these embodiments, the magnetic latch can comprise at least one magnet. Further, in these embodiments, the first arm, the second arm, the hinge, and/or the at least one earpiece can comprise a magnetic material that is attracted to the at least one magnet such that the magnetic latch releasably holds the first arm and the second arm when the first arm and the second arm define the first angle.

In at least one embodiment, a headphone unit is provided that can comprise a foldable headband and at least one earpiece connected to the foldable headband. In these embodiments, the foldable headband can include a first arm, a second arm, and a hinge connecting the first arm to the second arm, wherein the hinge comprises a torsional member.

In at least one embodiment, a headphone unit is provided that can comprise a foldable headband and at least one earpiece connected to the foldable headband. In these embodiments, the foldable headband can include a first arm, a second arm, and a hinge connecting the first arm to the second arm. Additionally, in these embodiments, the first arm and the second arm are rotatable between a first angle and a second angle defined between the first arm and the second arm. Further, in these embodiments, the hinge can comprise an adjustment member configured to adjust the second angle.

In at least one embodiment, a headphone unit is provided that can comprise a foldable headband and at least one earpiece connected to the foldable headband. In these embodiments, the foldable headband can include a first arm, a second arm, a hinge connecting the first arm to the second arm, and a magnetic latch operably coupled to the first arm. Additionally, in these embodiments, the first arm and the second arm are rotatable between a first angle and a second angle defined between the first arm and the second arm. Further, in these embodiments, the magnetic latch can comprise at least one magnet. Additionally, in these embodiments, the first arm, the second arm, the hinge, and/or the at least one earpiece can comprise a magnetic material that is attracted to the at least one magnet such that the magnetic latch releasably holds the first arm and the second arm when the first arm and the second arm define the first angle.

In at least one embodiment, a hinge is provided that can comprise a first rotatable member including a first protrusion extending from a first body, a first wedge fixedly connected to the first body, a second rotatable member including a second protrusion extending from a second body, an axel fixedly connected to the second body, a stopper slidably engaged with the axel, wherein the stopper comprises a second wedge, and an adjustment member. In these embodiments, the first body and the second body define a rotation axis, wherein the first body and the second body are rotatable with respect to each other between a first angle and a second angle defined between the first protrusion and the second protrusion. Further, in these embodiments, the adjustment member is accessible to a user and operably connected to the stopper such that movement of the adjustment member relative to the stopper causes the stopper to translate parallel to the axis, wherein the first wedge and the second wedge are configured to engage each other when the first protrusion and the second protrusion define the second angle.

FIGURES

Various embodiments of the present invention are described herein by way of example in conjunction with the following figures, wherein:

FIGS. 1, 2A-B, and 3A-B illustrate a headphone set according to various embodiments of the present invention;

DESCRIPTION

Figure 1:
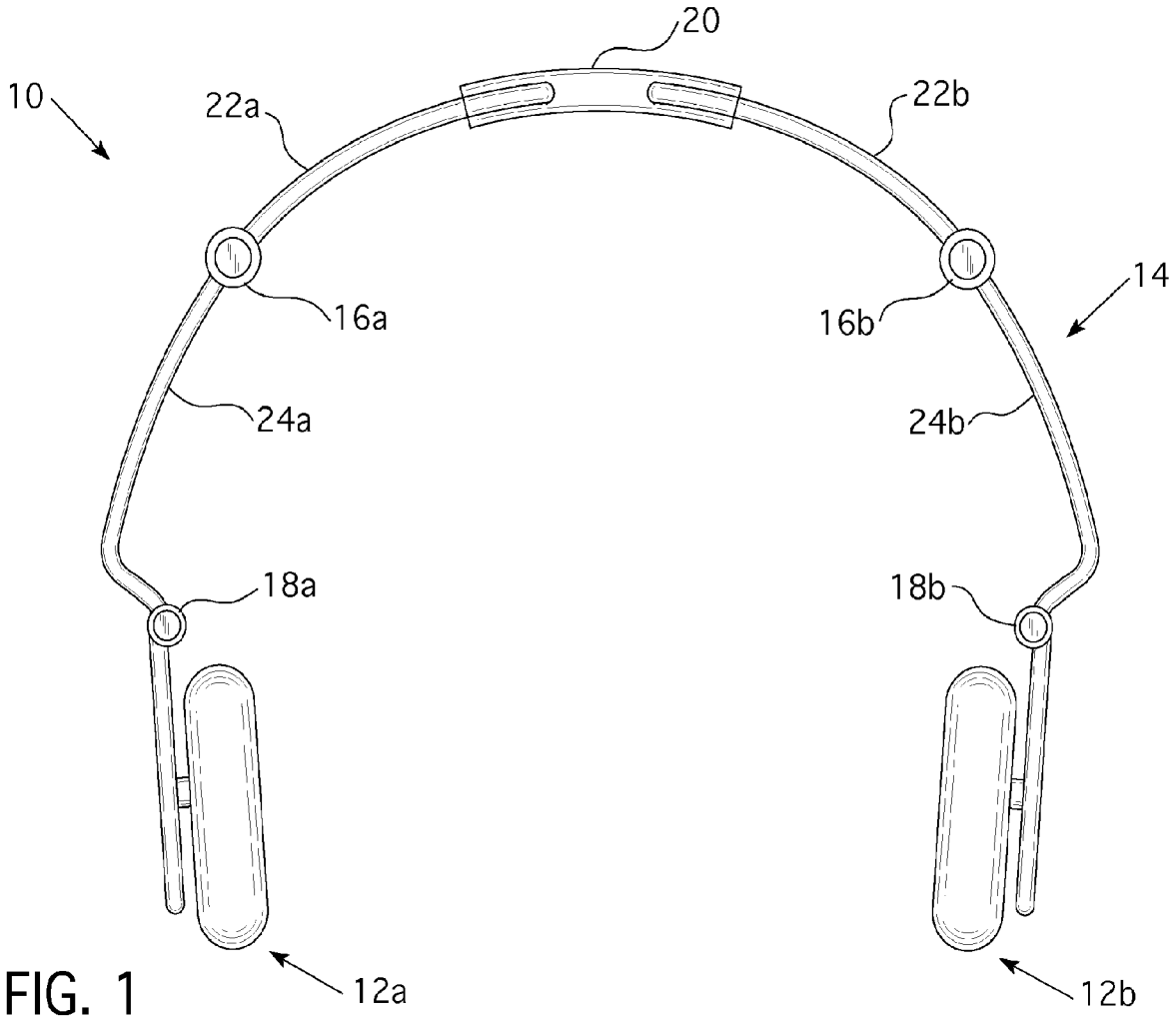

Certain exemplary embodiments will now be described to provide an overall understanding of the principles of the structure, function, manufacture, and use of the devices and methods disclosed herein. One or more examples of these embodiments are illustrated in the accompanying drawings. Those of ordinary skill in the art will understand that the devices and methods specifically described herein and illustrated in the accompanying drawings are non-limiting exemplary embodiments and that the scope of the various embodiments of the present invention is defined solely by the claims. The features illustrated or described in connection with one exemplary embodiment may be combined with the features of other embodiments. Such modifications and variations are intended to be included within the scope of the present invention.

In the following description, like reference characters designate like or corresponding parts throughout the several views. In addition, it is to be understood that such terms as "forward," "rearward," "front," "back," "right," "left," "upwardly," "downwardly," and the like are words of convenience and are not to be construed as limiting terms. The description below is for the purpose of describing various embodiments of the invention and is not intended to limit the invention thereto.

Figure 2A:
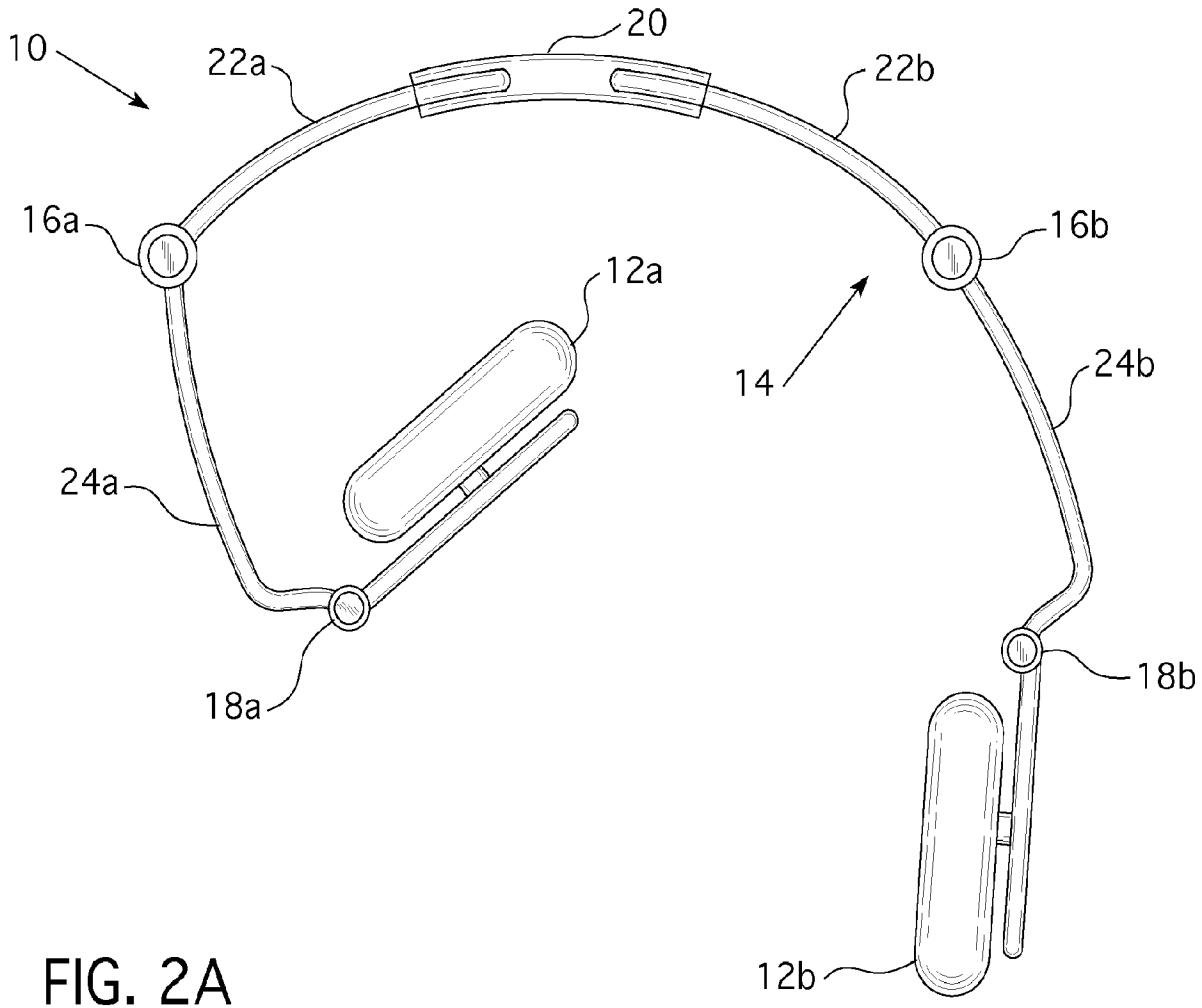
Figure 2B:
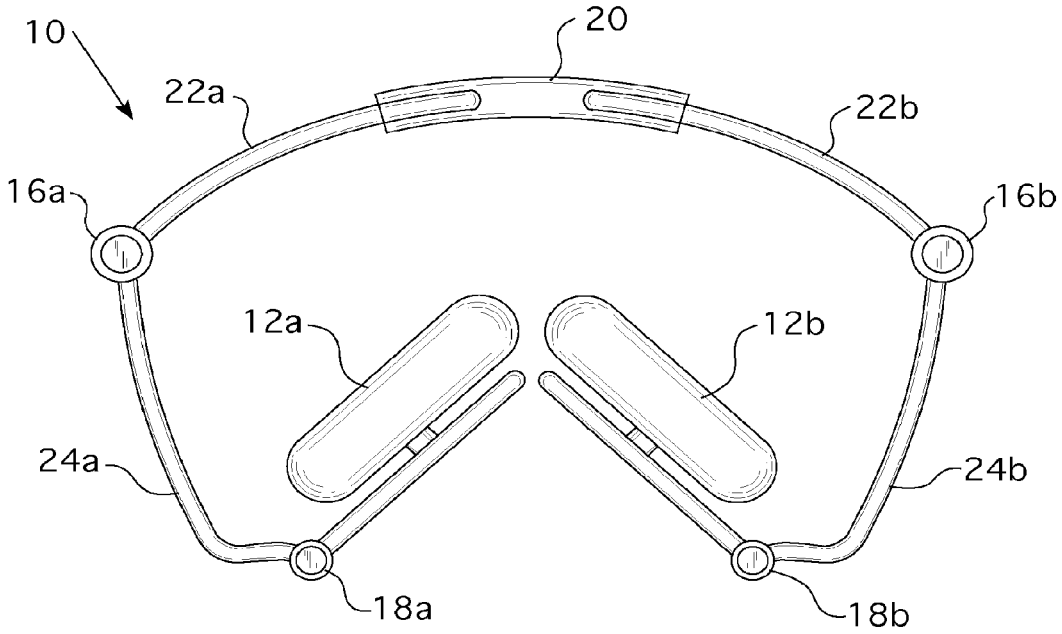
Figure 3B:
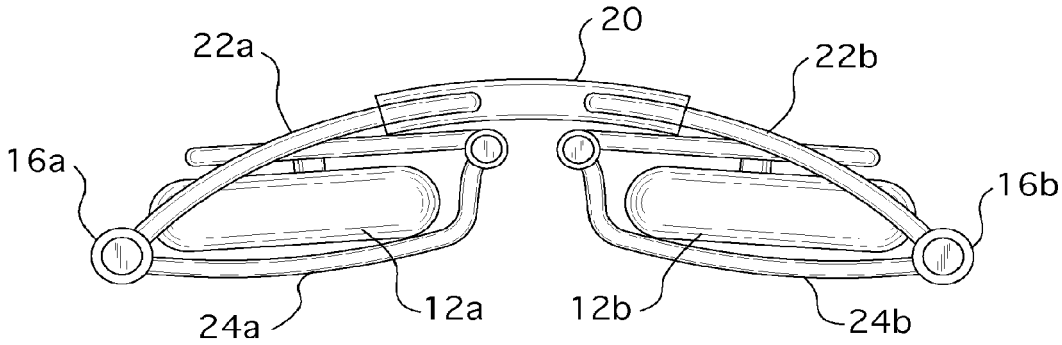
Figure 3A:
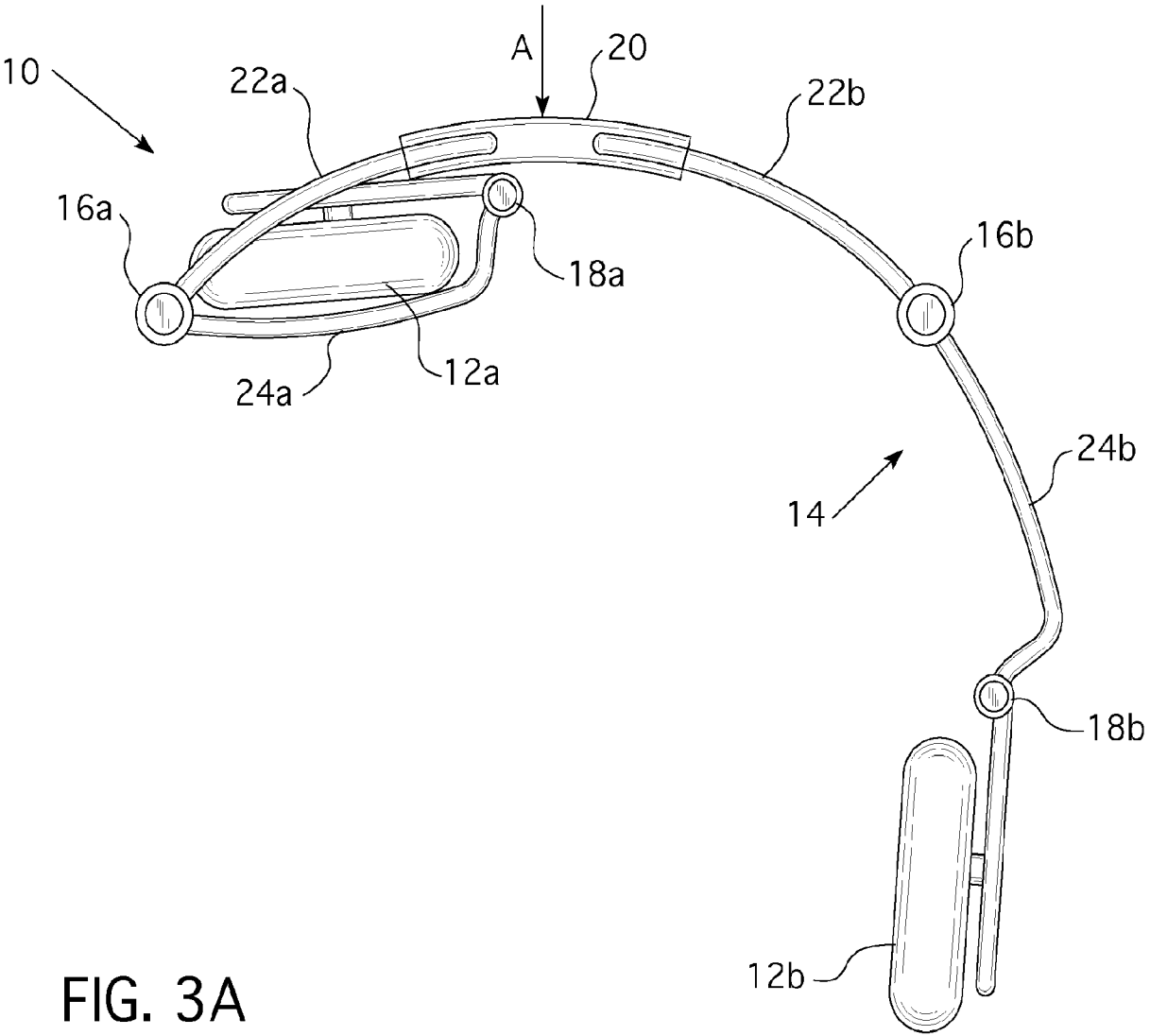

In at least one embodiment, the present invention is directed to a headphone set comprising a foldable headband. FIGS. 1-3 illustrate a headphone set 10 according to various embodiments of the preset invention at various stages of folding. As shown in these figures, according to the illustrate embodiment, the headphone set 10 comprises a pair of earpieces 12*a,b*, and a foldable headband 14. The headband 14 may comprise two upper, torsion- or spring-loaded hinge members 16*a,b*, and two lower, torsion- or spring-loaded hinge members 18*a,b*. The foldable headband 14 may also comprise a magnetic latch 20 (described further below), a pair of upper arms 22*a,b* connected between the magnetic latch 20 and the upper hinge members 16*a,b* respectively, and a pair of lower arm members 24*a,b* connected between the upper hinge members 16*a,b* and the corresponding lower hinge member 18*a,b* respectively. FIG. 1 shows the headphone set 10 fully open (or unfolded); FIG. 2A shows the headphone set with one earphone 12*a* partially folded; FIG. 2B shows the headphone set with both earphones 12*a,b* partially folded; FIG. 3A shows the headphone set with one earphone 12*a* fully closed (or folded); and FIG. 3B shows the headphone set with both earphones 12*a,b* fully closed.

The earpieces 12*a,b* may comprise speaker elements that comprise acoustic transducers that convert electrical signals to acoustic energy. The earpieces 12*a,b* may be on-ear, over-ear, or in-ear earpieces, multiple transducer earpieces, or any other suitable type of earpiece.

According to various embodiments, when the headphone set 10 is in its folded position (see FIG. 3B, for example), the magnetic latch 20 may magnetically attract a portion of the headphone set 10, such as the lower hinge members 18*a,b* or the earpieces 12*a,b* to thereby hold the headphone set 10 in its closed or folded position. When the magnetic latch 20 is actuated, the magnetic field is altered so that magnetic latch 20 is no longer able to overcome the force of the spring-loaded upper hinge members 16*a,b*. As a result, the headphone set 10 unfolds. In addition, according to various embodiments, the upper hinge members 16*a,b* each include a knurl dial that allows the user or wearer of the headphone set 10 to adjust or limit how far the lower arms 24*a,b* rotate outwardly when the headband 14 is unfolded. That way, when the headband 14 is unfolded, the lower arms 24*a,b* rotate only to the user-established limit position. As a result, the user could set the limit position one time using the knurl dial, and the headband 14 would rotate to the set position every time thereafter when unfolded, until the set position is readjusted. This gives the headphone set 10 a "set-and-forget" quality; the user can set the limits of the lower arm members 24*a,b* to a desired rotation or position for maximum comfort, and thereafter the headband 14 will unfold to the desired position, without the user having to readjust the headband 14 each time it is unfolded and used.

The hinge members 18*a,b* may be comprised of a ferromagnetic material, such as stainless steel. The magnetic latch 20, according to various embodiments, comprises two magnetic rails (not shown) molded into a molded, non-ferromagnetic material, such as silicone or any other suitable material. The magnetic rails may attract the hinges 18*a,b* when the headphone 10 is folded up and hold the earphones 12*a,b* in the folded position. A user or wearer of the headphone set 10 may press the magnetic latch 20 downwardly at or around is upper portion, as indicated by the arrow A in FIG. 3A, to deform the moldable material, and thereby change the shape of the moldable material, and hence the orientation of the magnetic rails embedded therein, and thereby lessen the magnetic attraction between the magnetic rails and the hinges 18*a,b* so that the magnetic forge between the earphones 18*a,b* and the magnetic rails is not great enough to overcome the spring-biased hinge members 16*a,b*, thereby causing the earphones 12*a,b* to unfold to the open position.

Figure 4:
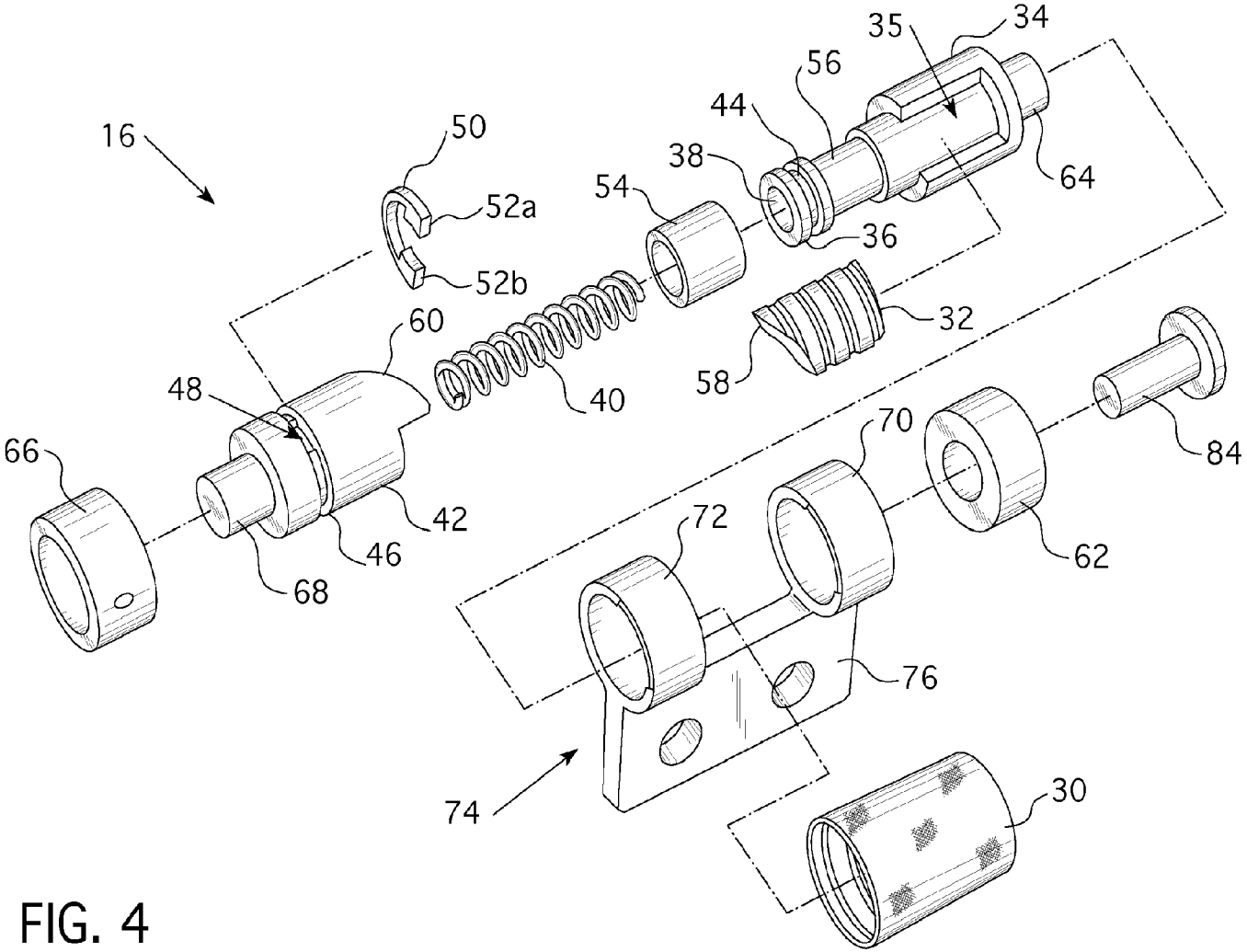
FIGS. 4-6 illustrate a hinge of the headphone set according to various embodiments of the present invention.

FIG. 4 is an exploded view of one of the spring-loaded hinge members 16 according to various embodiments of the present invention. In at least one embodiment, both hinges 16*a,b* are constructed as shown in FIG. 4. Further, in various embodiments, hinges 18*a,b* may also be constructed similar to that shown in FIG. 4. As shown in FIG. 4, the hinge 16 comprises a generally cylindrical knurl dial 30 that defines a borehole therethrough. The knurl dial may have inner threads along the borehole that may engage threads on the outer surface of a generally cylindrical stopper 32. The stopper 32 may also have a borehole therethrough. In such embodiments, the stopper 32 sits in a first annular channel 35 defined by a right insert 34, with an axial piece 36 of the right insert 34 inserted through the borehole of the stopper 32. Alternatively, the stopper may be only partially cylindrical; or arced. In such embodiments, the stopper 32 may sit in the first annular channel 35, with a surface of the right insert 34 supporting the stopper 32. In either case, in various embodiments, the stopper 32 may slide or translate along right insert 34 so that stopper 32 moves relative to a wedge 60, as described below. The axial piece 36 also defines an axial opening 38 in which a torsional member, such as spring 40, is inserted. The axial piece 36 of the right insert 34 is inserted into an axial opening (not shown) in the left insert 42. The right insert 34 also includes a second annular channel 44, which, when the axial piece 36 is inserted into the left insert 42, is aligned with an annular channel 46 defined by the left insert 42. The annular channel 46 of the left insert 42 includes openings, such as the opening 48 shown in FIG. 4. The annular channel 46 may also define another opening (not shown) on the opposite side of the channel 46 from the opening 46. A semi-circular retaining clip 50 having teeth 52*a,b* may be positioned in the channel 46 with each tooth 52*a,b* aligned with one of the openings 48 such that the teeth 52*a,b* will engage the axial portion 36 of the right insert 34 at the channel 44.

The hinge 16 may also include a friction grommet 54 that sits in a third annular channel 56 defined by the right insert 34, to the left of the first channel 35 in which the stopper 32 sits. The outer surface of the friction grommet 54 engages or interfaces with the inner surface of the left insert 42. The friction grommet 54 may be made of rubber, for example.

The stopper 32 includes a wedge 58 on its left hand side, which engages a wedge 60 defined at the right hand side of the left insert 42. As explained further below, adjusting the knurl dial 30 can adjust where the wedge 58 of the stopper 32 engages the wedge 60 of the left insert 42 when the headphones 10 are unfolded, to thereby limit how far the headphones open. The torsional member, such as spring 40, may be, according to various embodiments, a compression or tension coil spring that acts like a torsion spring because of tabs (not shown) on each end of the spring 40 that engage and are retained by corresponding openings on the inner surface of the right insert 34 and the left insert 42 respectively, to thereby lock the spring 40 in place. Alternatively, the hinge 16 may include other torsional members in place of or in addition to spring 40. For example, the torsional member may include, but is not limited to, one or more of the following: spring 40, an elastomer, a coil spring, a torsion spring, a spiral spring, and an elastic material. The friction grommet 54 may limit how fast the headphones unfold because of the friction between the friction grommet 54 and the Inner surface of the left insert 42, to provide thereby a controlled, smooth opening for the earphones 12*a,b*.

A right annular end cap 62 sits around a cylindrical stem 64 of the right insert 34. Similarly, a left annular end cap 66 sits around a cylindrical stem 68 of the left insert 42. The end caps 62, 66 are adjacent to respective annular rings 70, 72 of hinge piece 74. The hinge piece 74 may comprise a plate 76 that attaches to one of the lower arms 24*a,b* of the headphone 10. Respective wire frames 80, 82 may be connected, such as by welding or any other suitable means, to the end caps 62, 66. The wire frames 80, 82 may form a portion of the upper arms 22*a,b* of the headphone set 10.

A retaining pin 84 is inserted into a bore defined by the stem 64 of the right insert. The knurl dial 30 sits between the rings 70, 72 of the hinge piece 74. According to various embodiments, the left end cap 66 is fixedly connected to the stem 68 of the left insert 42, such as by a pin (not shown). As such, the end cap 66 will not be able to rotate freely relative to the stem 68 of the left insert 42. Likewise, the right ring 70 may be fixedly connected to the right insert 34, such as by a pin (not shown). Alternatively, the right end cap 62 may be fixedly connected to the stem 64 of the right insert 34 and the lift ring 72 may be fixedly connected to the left insert 42. In any case, rotation of hinge piece 74 relative to end caps 62, 66 about hinge 16 may apply torque to or receive torque from spring 40. Therefore, the torsion action of the spring 40 will cause the right insert 34 to tend to rotate relative to the left insert 42. When one of the earphones 12*a,b* are rotated from the open position (see FIG. 1) to the closed position (see FIG. 3A or 3B), the right insert 34 rotates relative to the left insert 42 so that the right insert moves away from the left insert 42, and potential energy is stored in spring 40 as it is wound tighter.

Figure 5:
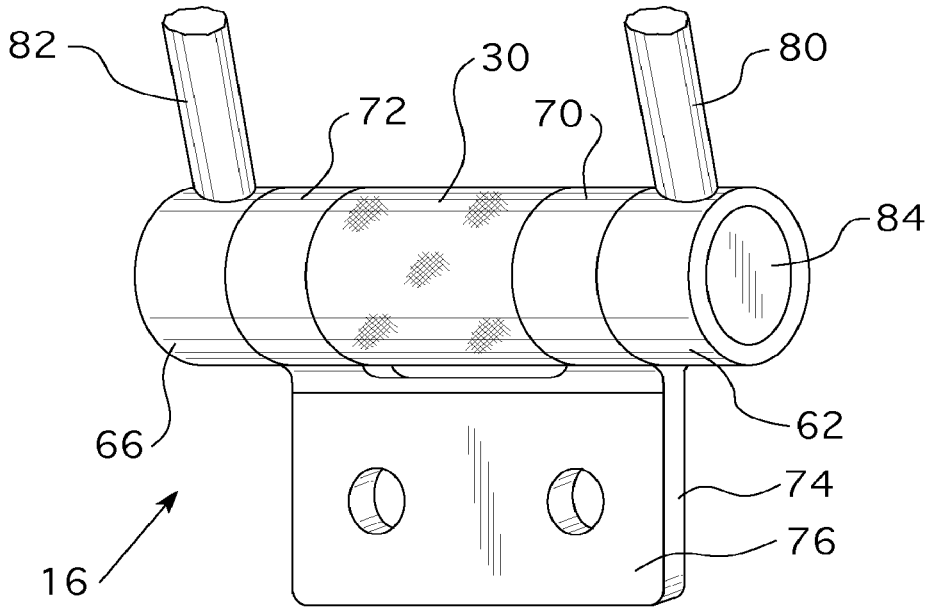
Figure 6:
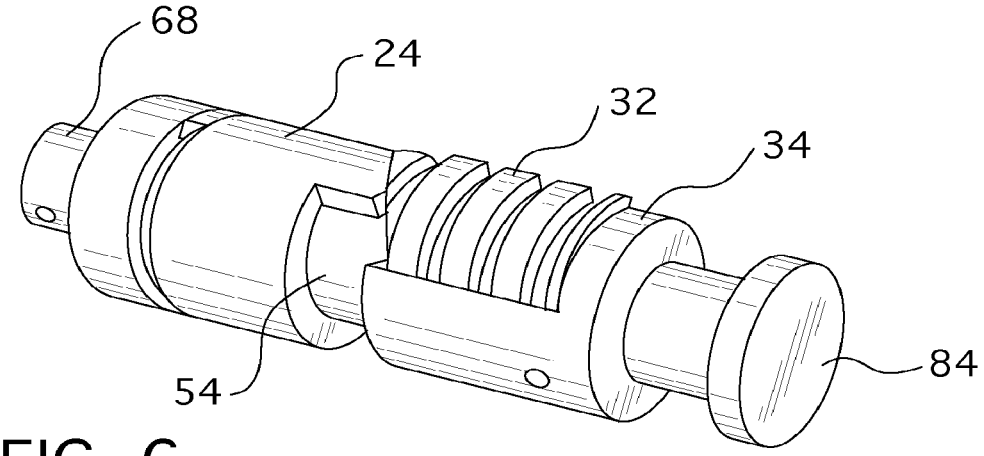

FIGS. 5 and 6 show assembled version of the hinge 16. FIG. 5 shows the hinge 16 assembled with the hinge piece 74 and FIG. 6 shows the hinge 16 assembled without the hinge piece 74 or the end caps 62, 66.

The following will describe the operation of the hinge 16 according to various embodiments of the present invention. The discussion below describes the hinge 16 as being used for hinge 16*a* to unfold earphone 12*a*, realizing that the hinge could be used for hinge 16*b* as well. The description for hinge 16*a* below applies equally to hinge 16*b* in such embodiments, so it is not repeated here.

In the closed or folded position, the user can adjust the knurl dial 30 of the hinge 16*a*. Adjustment of the knurl dial 30 translates the stopper 16 axially along the axial portion 36 of the right insert 34, either toward or away from the left insert 42 depending on the direction of the rotation by the user of the knurl dial 30, to control thereby the angle, or relative angular position, at which the wedge 58 of the stopper 32 engages the wedge 60 of the left insert when the hinge 16 flies open due to the spring action provided by the spring 40.

When the earphone 12*a* is unfolded, such as by pressing the magnetic latch 20, the stopper 32 translates axially until the wedge 58 of the stopper 32 engages the wedge 60 of the left insert 42, which stops the axial translation of the stopper 32 and, hence, the relative rotation of the right insert 34, thereby causing the earphone 12*a* to unfold to the predetermined position established by the user through rotation of the knurl dial when the earphone 12*a* was in the closed position. That way, the hinge 16*a* will unfold to practically the same position every time until the knurl dial is adjusted again. This provides the user with a custom fit. Further, the friction between the friction grommet 54 and the left insert 42 may provide for a slowed, controlled, smooth opening of the earphone 12*a*.

Thus, referring now to FIGS. 1-4, in various embodiments, a headphone unit, such as headphone set 10, for example, may comprise a foldable headband, foldable headband 14, for example, including a first arm, upper arm 22*a*, for example, a second arm, lower arm 24*a*, for example, and a hinge, upper hinge member 16*a*, for example, connecting the first arm to the second arm, wherein the hinge comprises a torsional member, spring 40 (see FIG. 4), for example, and at least one earpiece, earpiece 12*a*, for example, connected to the foldable headband. As described above, the torsional member may be configured to cause the hinge to urge the first arm and the second arm to rotate with respect to each other. For example, spring 40 may apply a torque between upper arm member 22*a* and lower arm member 24*a* to cause the two arm members to rotate away from one another till the foldable headband 14 reaches an unfolded configuration as shown in FIG. 1. Further, the foldable headband may further comprise a second hinge, lower hinge member 18*a*, for example, connecting the earpiece to the first arm, wherein the second hinge comprises a second torsional member, spring 40, for example. The first and second hinges may be constructed similar to hinge 16 described above.

Also, still referring to FIGS. 1-4, in various embodiments, a headphone unit may comprise a foldable headband including a first arm, a second arm, and a hinge connecting the first arm to the second arm, wherein the first arm and the second arm are rotatable between a first angle and a second angle defined between the first arm and the second arm, wherein the hinge comprises an adjustment member, dial 30, for example, configured to adjust the second angle, and at least one earpiece connected to the foldable headband. The first angle may be a folded angle, as shown in FIGS. 3A and 3B, or a partially folded angle, as shown in FIGS. 2A and 2B. The second angle may be an unfolded angle, as shown in FIG. 1. The folded angle and the partially folded angle may be smaller than the unfolded angle. Further, the foldable headband may further comprise a second hinge connecting the earpiece to the second arm, wherein the second arm and the earpiece are rotatable between a third angle (a folded or partially folded angle, for example) and a fourth angle (an unfolded angle, for example) defined between the second arm and the earpiece, wherein the second hinge comprises a second adjustment member configured to adjust the fourth angle.

Additionally, again referring to FIGS. 1-4, in various embodiments, a headphone unit may comprise a foldable headband including a first arm, a second arm, a hinge connecting the first arm to the second arm, wherein the first arm and the second arm are rotatable between a first angle and a second angle defined between the first arm and the second arm, and a magnetic latch, magnetic latch 20, for example, connected to the first arm, wherein the magnetic latch comprises a magnet, and at least one earpiece connected to the foldable headband. The first arm, the second arm, the hinge, and/or the at least one earpiece may comprise a magnetic material, such as a ferromagnetic material like stainless steel, for example, that is attracted to the magnet such that the magnetic latch releasably holds the first arm and the second arm when the first arm and the second arm define the first angle. The magnet may create a magnetic field and the magnetic latch may be deformable to alter the orientation of the magnetic field produced by the magnet such that the attraction between the magnet and the magnetic material is decreased. Accordingly, the headphone unit may be released from its folded configuration when a user pulls an earpiece or a portion of the foldable headband away from the magnetic latch, or when a user deforms the magnetic latch.

Various combinations of the above-described components are also possible. For example, referring again to FIGS. 1-4, a headphone unit may comprise a foldable headband including a first arm, a second arm, and a hinge connecting the first arm to the second arm, wherein the first arm and the second arm are rotatable between a first angle and a second angle defined between the first arm and the second arm, wherein the hinge comprises an adjustment member configured to adjust the second angle, wherein the hinge comprises a torsional member, a magnetic latch operably coupled to the first arm, wherein the magnetic latch comprises a magnet, and at least one earpiece connected to the foldable headband. The first arm, the second arm, the hinge, and/or the at least one earpiece may comprise a magnetic material that is attracted to the magnet such that the magnetic latch releasably holds the first arm and the second arm when the first arm and the second arm define the first angle.

Various components of the hinge 16 may be made from metallic material, such as stainless steel. For example, the following components may be made from metal: the knurl dial 30; the stopper 32; the right insert 34; the left insert 42; the end caps 62, 64; the retaining pin 84; the retaining clip 50; and/or the hinge plate 74. The friction grommet 54 is preferably made of rubber.

Although the hinge 16 was described above as being part of a headphone set 10, alternative embodiments of the present invention are directed to the hinge 16 itself. It may be used in other devices or machines where a controlled opening, to a user-established limit, is desired.

Accordingly, referring now to FIGS. 4-6, in various embodiments, a hinge, hinge 16, for example, may comprise a first rotatable member including a first protrusion, wire frames 80, 82, for example, extending from a first body, end caps 62, 76, for example. The hinge may further comprise a first wedge, wedge 60 of left insert 42, for example, fixedly connected to the first body, via a pin (not shown), for example. The hinge may also further comprise a second rotatable member, hinge piece 74, for example, including a second protrusion, hinge plate 76, for example, extending from a second body, rings 70, 72, for example. The first body and the second body may define a rotation axis, wherein the first body and the second body are rotatable with respect to each other between a first angle and a second angle defined between the first protrusion and the second protrusion. Additionally, the hinge may comprise an axel, right insert 34, for example, fixedly connected to the second body, via a pin (not shown), for example, and a stopper, stopper 32, for example, slidably engaged with the axel, wherein the stopper comprises a second wedge, wedge 58, for example. The hinge may also comprise an adjustment member, dial 30, for example, that is accessible to a user and operably connected to the stopper such that movement of the adjustment member relative to the stopper causes the stopper to translate parallel to the axis, wherein the first wedge and the second wedge are configured to engage each other when the first protrusion and the second protrusion define the second angle. Further, the hinge 16 may further comprise a torsional member, spring 40, for example, operably coupled between the axel and the first wedge. Also, the hinge 16 may further comprise a damper, friction grommet 54, for example, that is operably engaged with the axel and the first body.

FIGS. 7-10 illustrate at least one additional embodiment of a headphone set 110 that includes a foldable headband 114. Foldable headphone set 110 is similar to headphone set 10, described above, except at least the magnetic latch 120 is constructed and functions differently, and the hinges 116*a,b* and 118*a,b* are constructed differently.

Figure 7:
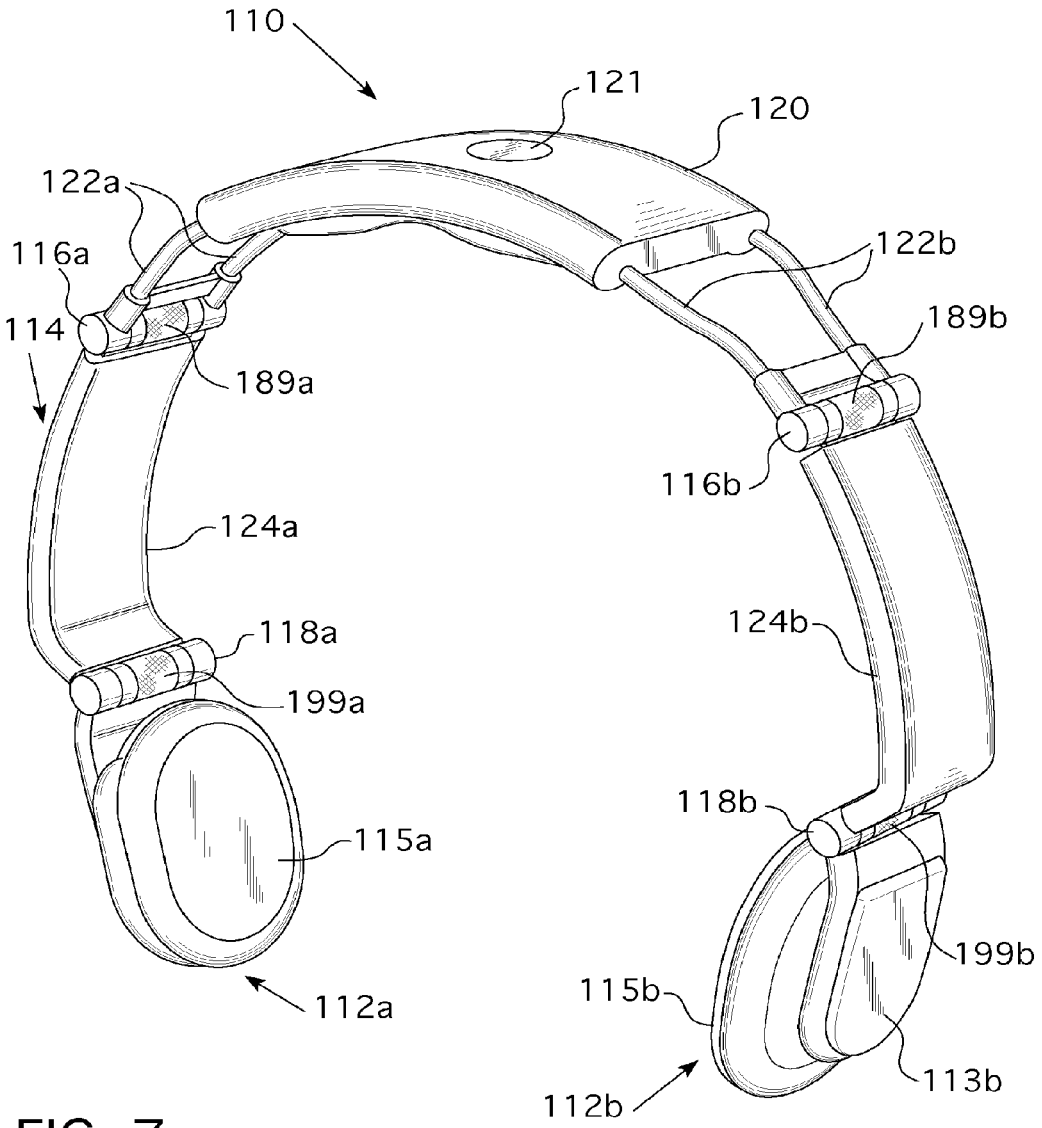
FIG. 7 is a perspective view of a headphone set according to various embodiments of the present invention.
Figure 8:
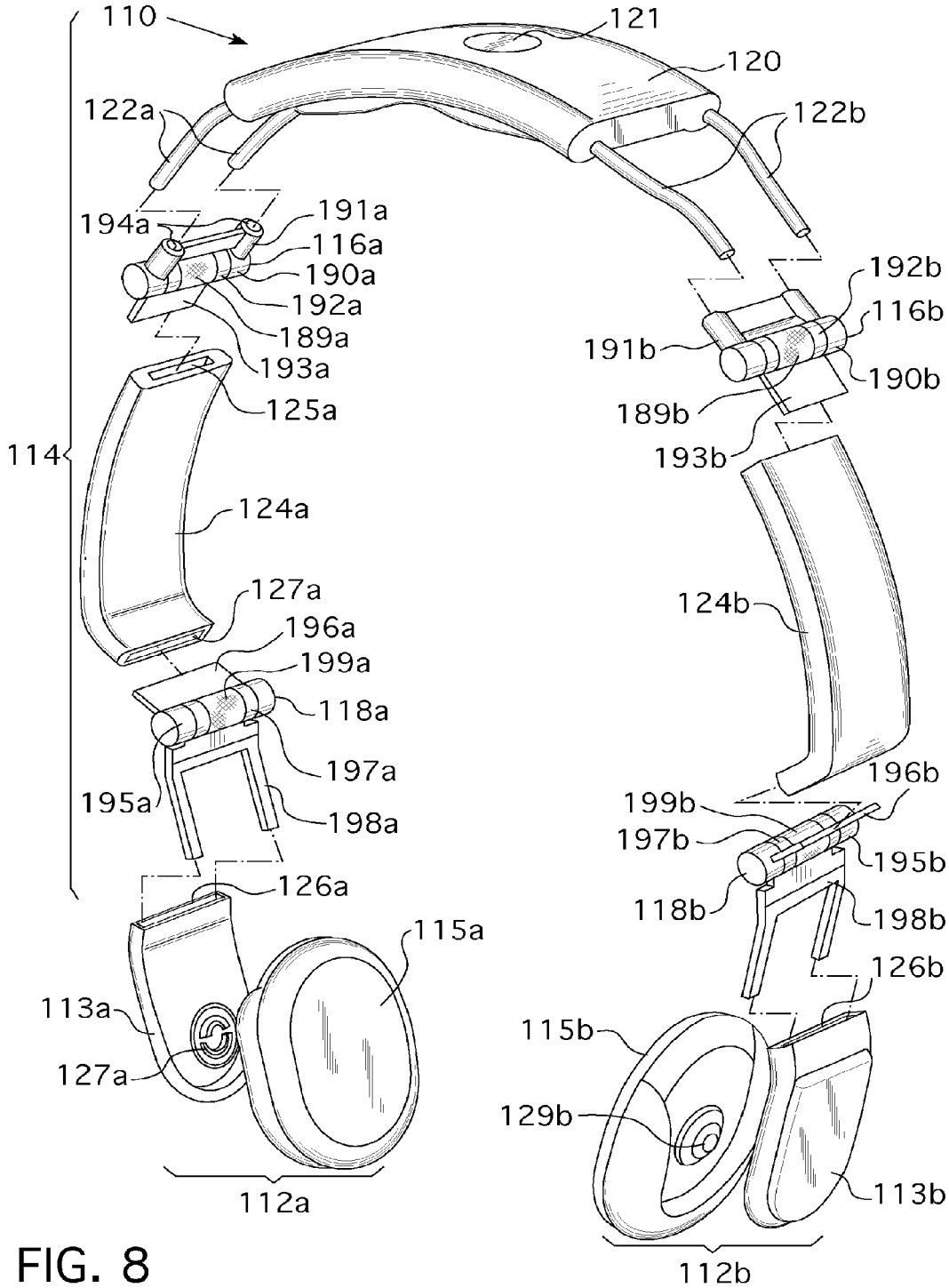
FIG. 8 is a partially exploded view of the headphone set of FIG. 7.

Focusing now on FIGS. 7-8, the headphone set may comprise a foldable headband 114, with two earpieces 115*a,b* attached thereto. The foldable headband 114 may comprise a magnetic latch 120. Symmetric about the latch 120, upper arms 122*a,b* extend outwardly therefrom. The upper arms 122*a,b* may connect to lower arms 124*a,b* via upper hinges 116*a,b*, which may include upper adjustment members 189*a,b*. As described in more detail below, movement of one or more of adjustment members 189*a,b* may adjust the angle or position to which the upper hinges 116*a,b* open when in an unfolded configuration, as shown in FIG. 7, for example. Lower arms 124*a,b* may connect to earpiece 112*a,b* via lower hinges 118*a,b*. Similar to the upper hinges 116*a,b*, lower hinges 118*a,b* may include lower adjustment members 199*a,b*. Each earpiece 112*a,b* may include an ear side 115*a,b* and a back side 113*a,b*. The back side 113*a,b* may comprise a magnetic material, such as stainless steel, for example.

The headphone set 110 may be folded similar to that described above for headphone set 10. Once completely folded, the back side 113*a,b* of earpieces 112*a,b* may be configured to be positioned directly beneath magnetic latch 120 and more specifically beneath magnets 200, shown in FIG. 9 and described below. When folded as such, the magnets 200 may attract the back sides 113*a,b* of earpieces 112*a,b* to releasably hold the headphone set in a folded configuration. Alternatively, as mentioned above, various other components of the headphone set 110 may include a magnetic material that may independently, or in addition to back side 113*a,b*, be attracted to the magnets 200 to releasably hold the headphone set in a folded configuration. Such other components may include one or more of arms 122*a,b*, 124*a,b* and/or hinges 116*a,b*, 118*a,b*, for example.

Figure 9:
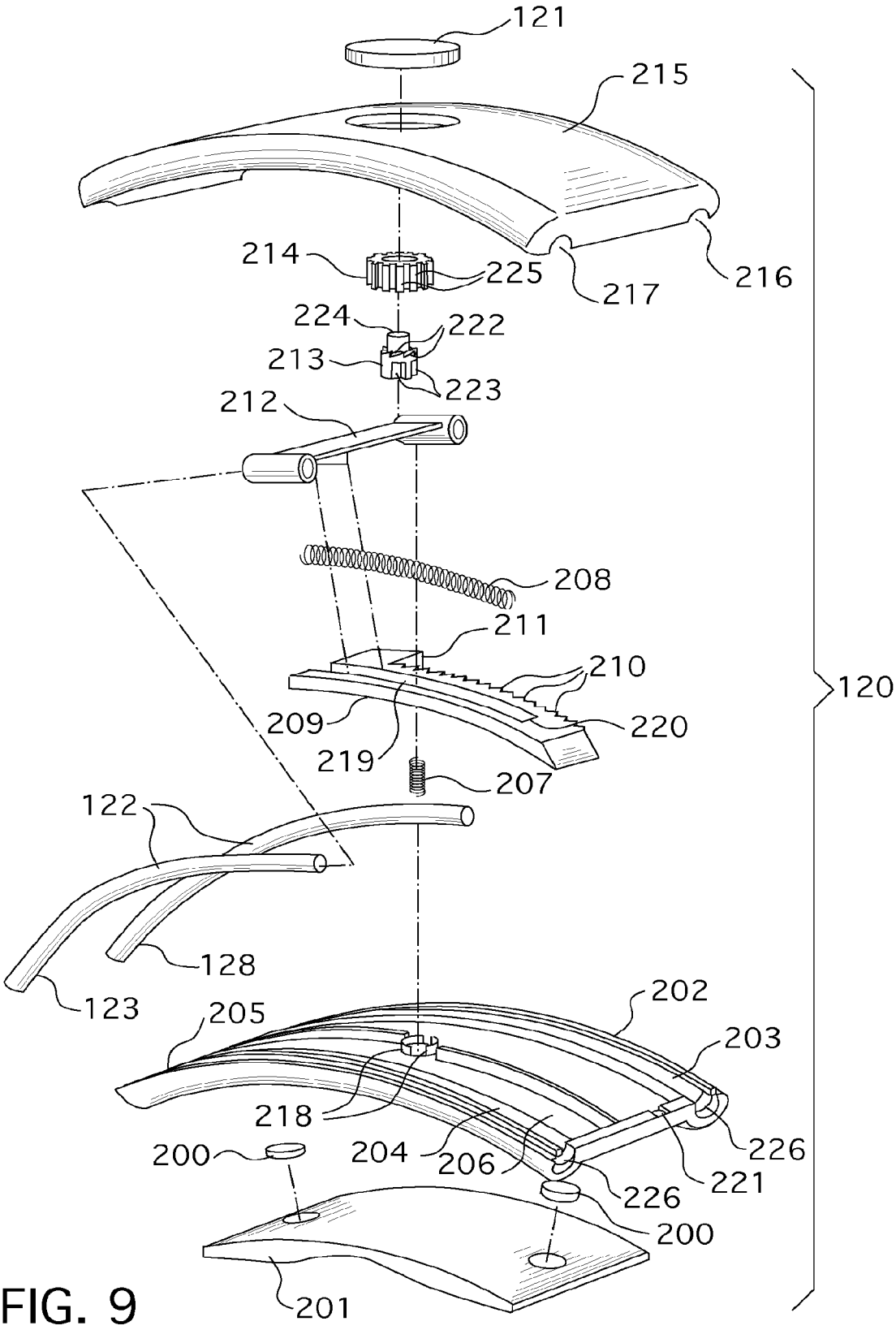
FIG. 9 is an exploded view of a portion of a headband assembly of the headphone set of FIG. 7.

Focusing now on FIG. 9, in various embodiments, the magnetic latch 120 may also include a control member, button 121, for example, that is configured to release the earpieces 112*a,b* from the folded configuration once the button 121 is actuated or depressed by a user. In such embodiments, the magnetic latch 120 may include a body, formed by one or more of upper piece 215, intermediate piece 202, and lower piece 201, for example. Each of pieces 201, 202, and 215 may be arcuate in shape such that they at least fit the top of an average wearer's head. The lower piece 201 may be made of a soft foam material, for a wearer's comfort, and include one or more recesses defined therein that are sized and configured to hold at least one magnet, such as two magnets 200, for example. The lower piece 201 may be sized and configured to be attached to intermediate piece 202 by an adhesive, a weld, or a press-fit feature, for example. Accordingly, magnets 200 may be held within the lower piece 201 once the lower piece 201 is attached to the intermediate piece 202. The intermediate piece 202 is likewise sized and configured to correspondingly mate with the upper piece 215 and may be attached thereto by an adhesive, a weld, or a snap-fit feature, for example. Accordingly, various components of the magnetic latch 120, described below, may reside within the lower piece 201, intermediate piece 202, and/or upper piece 215 which together may define a body of the latch 120.

Still referring to FIG. 9, the latch 120 may also include a movable member, rack 209, for example, that is slidably associated with the body, and a resilient member, extension spring 208, for example. In such embodiments, the resilient member may be received within a channel 219 defined by rack 209. Further, the resilient member may engage and/or attach to a portion of the movable member, at channel end 220, for example, and also engage and/or attach to a portion of the body, at side portion 205, for example. Although not shown, the extension spring 208 may be attached to the channel end 220 by hooking a portion of the spring 208 onto a protrusion extending within the channel 219. Also, the spring 208 may attach to the intermediate piece 202 by a post at side portion 205 that is similar in size and shape to a post 221 shown at another side portion of the intermediate piece 202. The rack 209 may be arcuate in shape to correspond with the shape of upper surface 206 of intermediate piece 202. The extension spring 208 may therefore be positioned between extension channel end 220 and side portion 205 while the rack 209 is slidably associated on surface 206. Accordingly, movement of the extension 211 away from side portion 205 may extend spring 208 such that the spring is stretched and potential energy is stored within the spring 208. Therefore, when extended, the spring 208 may pull or urge the rack 209, via channel end 220, toward side portion 205.

However, the latch 120 may releasably resist such movement of the rack 209 by way of a clutch assembly operably coupled between the movable member and the body. The clutch assembly may include a spur gear or pinion 214 freely rotatably with respect to the upper and lower pieces 215, 202. The pinion 214 may include teeth 225 designed to engage complimentary shaped teeth 210 formed in rack 209. Received within pinion 214 may be a clutch 213 about a portion of which pinion 214 may rotate, as described below. However, clutch 213 may also include angled teeth 222 formed therein that are designed to engage complimentary angled teeth formed inside pinion 214 (not shown). The clutch 213 is configured to resist rotation and may only translate toward and away from upper piece 215 by way of fingers 218 protruding from intermediate piece 202. Fingers 218 may be sized and configured to be received in indentions 223 formed in the bottom of clutch 213 thereby preventing rotation of clutch 213, while allowing clutch 213 to slidably translate with respect to the fingers 218 and upper piece 215. Further, clutch 213 may be urged toward pinion 214 by a compression spring 207 that is mounted between intermediate piece 202 and a portion of the clutch 213. Accordingly, absent external force, the spring 207 may press the clutch 209 into pinion 214 such that angled teeth 222 of the clutch 213 engage the similarly angled teeth inside the pinion 214. Once engaged, the teeth-to-teeth interaction between the pinion 214 and the clutch 213 may prevent the pinion 214 from freely rotating. When arrested as such, the pinion 214 subsequently prevents the rack from moving owing to the interface between the external teeth 225 of the pinion 214 and the teeth 210 of the rack 209.

The pinion 214 may freely rotate, however, once the angled teeth 222 of the clutch 213 are disengaged from the internal angled teeth of the pinion 214. This may occur by way of the above mentioned user-accessible control member, button 121, for example. The control member may accordingly be configured to release the clutch assembly. In various embodiments, the button 121, which may sit in an opening defined within upper piece 215, may be operably engaged with the clutch assembly by hub 224 protruding upwards from teeth 222 of the clutch 213. Accordingly, a user may press down on the button 121, thereby forcing the hub 224, and the rest of the clutch 213 to compress compression spring 207 and move the angled teeth 222 of the clutch 213 away from the internal teeth of the pinion 214. Once the teeth 222 are disengaged from the pinion 214, the pinion 214 may freely rotate about hub 224 and, subsequently, the rack 209 may slide within upper and lower pieces 215, 202 along surface 206. Therefore, when the rack 209 is moved away from side portion 205, the extension spring 208 may apply a tensile force to the rack 209, attempting to pull the rack 209 back toward side portion 205. However, as long as the teeth 222 of clutch 213 are engaged with the internal teeth of pinion 214, the pinion 214 will resist movement of the rack 209 toward the side portion 205. Depressing the button 121 may disengage the teeth-to-teeth lock between the clutch 213 and the pinion 214, thereby allowing the pinion 214 to rotate and the rack 209 to be moved, by spring 208, toward side portion 205.

In various embodiments, still referring to FIG. 9, even if the button 121 is not depressed, rack 209 may also be moved in one direction along pinion 214 via a ratcheting mechanism involving the pinion 214, the clutch 213, and the compression spring 207. For example, the angled teeth 222 of the clutch 213 and the inner teeth (not shown) of the pinion 214 may be angled such that force applied to the rack away from side portion 205 may force the clutch 213 downward, against spring 207. Once the inner pinion teeth move clutch teeth 213 downward, the rack may advance toward side portion 205. However, because the compression spring 207 urges the clutch 213 upwards, the pinion 214 is allowed to rotate in a ratcheting fashion. Accordingly, absent actuation of button 121, the rack 209 also may only be allowed to move in one direction, away from side portion 205 because of the above-described ratcheting mechanism.

It will be recognized that, for purposes of illustration, FIG. 9 only shows one upper arm assembly 122 connected to magnetic latch 120. It will be further understood that in a symmetric arrangement, the magnetic latch 120 may connect to another upper arm assembly that would include similar components to connect the second arm assembly to the magnetic latch as that described above. Accordingly, the upper arms 122*a,b*, as seen in FIGS. 7-8, may both be operably attach to the magnetic latch 120 in a similar symmetric fashion.

As seen in FIGS. 7-8, the magnetic latch may be connected to upper arms 122*a,b*. Focusing again on FIG. 9, which for purposes of clarity only shows one such arm 122, arm 122 may comprise two wire frames 123, 128, that may be connected to the wire frames 123, 128 via a bridge 212. Bridge 212 may include ports defined therethrough for receiving the wire frames 123, 128. Wire frames 123, 128 may be attached to the bridge 212 by an adhesive, a weld, a fastener, and/or a press-fit feature, for example. The bridge may also be attached to rack 209 at extension 211 that may protrude from a body portion of the rack 209. The extension 211 may attach to bridge 212 by an adhesive, a weld, a fastener, and/or a press-fit feature, for example.

Referring still to FIG. 9, the wire frames 123, 128 may be slidably received within channels 204, 203, respectively, that are formed in intermediate piece 202. Defined at the side portion 205 of intermediate piece 202 are grommet holders which, while not visible from the viewing angle of FIG. 9, are similar to holders 225 shown at the opposite side portion. The holders 225 may receive friction grommets or dampers (not shown) that are sized and configured to insertably receive wire frames 123, 128 of arm 122. Accordingly, any sliding motion of arm 122 in or out of magnetic latch 120 may be slow and controlled.

Referring now to FIG. 7, a user may fold the headphone set by rotating the earpieces 112*a,b* toward their respective lower arms 124*a,b*, about lower hinges 118*a,b*. The lower arms 124*a,b* may also be rotated toward upper arms 122*a,b* about upper hinges 116*a,b*. Also, the user may press the upper arms 122*a,b* toward and/or into magnetic latch 120, thereby forcing the upper arms 122*a,b* to move at least partially into the magnetic latch 120 and ratchet racks 209 along pinion 214 as described above. Briefly turning to FIG. 9, as the racks 209 are pushed within latch 120, extension springs 208 may extend, thereby resisting and pulling on racks 209. However, the clutch 213 may releasably hold the pinion 214 and only allows it to turn in one direction, that correlating with the arms 122*a,b* moving toward each other and/or further within latch 120. Thereafter, the racks 209 may be considered loaded by the force applied by extension springs 208, but racks 209 may not move as urged by the springs 208 because of the ratcheting and/or locking design of the clutch 213 and the pinion 214.

Referring back to FIG. 7, once the upper arms 122*a,b* are pressed at least partially into magnetic latch 120, and the arms 122*a,b*, 124*a,b* are rotated or folded as described above, the back sides 113*a,b* of earpieces 112*a,b* may subsequently be positioned underneath magnets 200 held in lower piece 201 of magnetic latch 120. The magnets 200 may create a magnetic field that is strong enough to releasably hold the back sides 113*a,b*, of earpieces 112*a,b* which may include a magnetic material, as discussed above. Accordingly, the headphone set 110 may be held in a folded configuration.

However, as mentioned above and referring to FIG. 9, when the control member, button 121, for example, is actuated by a user, the control member may be configured to release the clutch assembly, including clutch 213, for example, such that the resilient member, extension spring 208, for example causes the movable member, rack 209, for example, to move the first arm, upper arm 122*a*, for example, relative to the body, pieces 201, 202, 215, for example, such that the magnetic material, that of back side 113*a*, for example, is moved away from the magnet, magnet 200, for example.

In other words, referring now to both FIGS. 7 and 9, when the headphone set 110 is folded such that the earpieces 113*a,b* are held by magnets 200, a user may depress button 121. Actuating button 121 may cause the clutch 213 to drop and disengage teeth-to-teeth contact between clutch teeth 222 and inner teeth of pinion 214. Subsequently, the pinion 214 is allowed to freely rotate and the extension springs 208 may release their potential energy by pulling and thereafter moving racks 209 toward their respective sides of latch 120. This motion pushes arms 122*a,b*, upper hinges 116*a,b*, lower arms 124*a,b*, lower hinges 118*a,b*, and earpieces 112*a,b* out and away from magnetic latch 120. Subsequently, magnetic material, such as that which may be part of the back sides 113*a,b*, may no longer be in close proximity to magnets 200 to continue to be held in a folded configuration. Owing to torsional members, such as spring 204, described below (see FIG. 10), associated with the hinges 116*a,b*, 118*a,b*, the headphone set may thereafter automatically unfold to an unfolded configuration, like that seen in FIG. 7.

The unfolded configuration of headphone set 110 seen in FIG. 7 may be just one of many possible unfolded configurations. For example, in various embodiments, a near infinite number of unfolded configurations may be possible, because a user may adjust a stop or limit position of one or more of hinges 116*a,b*, 118*a,b* similar to that described above with respect to headphone set 10. In other words, one or more of the hinges 116*a,b*, 118*a,b* may be rotatable between a first angle, corresponding with a folded configuration, for example, and a second angle, corresponding with an unfolded configuration as seen in FIG. 7, for example, defined by portions of the upper arms 122*a,b* and the lower arms 124*a,b* as appropriate, or by portions of lower arms 122*a,b* and earpiece back sides 113*a,b* as appropriate. In these embodiments, each adjustable hinge may comprise an adjustment member, for example one of adjustment members 189*a,b*, 199*a,b* as appropriate, that may be configured to adjust the second angle.

The hinges 116*a,b*, 118*a,b* may be similar in construction and function. Focusing now on FIG. 8, each hinge 116*a,b*, 118*a,b* may include a first rotatable member including a first protrusion 193*a,b*, 198*a,b* extending from a first body 192*a,b*, 197*a,b*. Further, each hinge 116*a,b*, 118*a,b* may include a second rotatable member including a second protrusion 191*a,b* 196*a,b* extending from a second body 190*a,b*, 195*a,b*. The upper hinges 116*a,b* may interconnect upper arms 122*a,b* to lower arms 124*a,b*. For example, the upper hinges 116*a,b* may be connected to upper arms 122*a,b* via ports 194*a,b* defined in protrusions 191*a,b* that are sized and configured to receive the arms 122*a,b* (note, port 194*b* is not visible from the viewing angle of FIG. 8). Also, upper hinges 116*a,b* may be connected to lower arms 124*a,b* via slots 125*a,b* defined in lower arms 124*a,b* that are sized and configured to receive protrusions 193*a,b* of upper hinges 116*a,b* (note, slot 125*b* is not visible from the viewing angle of FIG. 8). Likewise, the lower hinges 118*a,b* may interconnect lower arms 124*a,b* to the back sides 113*a,b* of earpieces 112*a,b*. For example, the lower hinges 118*a,b* may be connected to lower arms 124*a,b* via slots 127*a,b* defined in lower arms 124*a,b* that are sized and configured to receive protrusions 196*a,b* of lower hinges 118*a,b* (note, slot 127*b* is not visible from the viewing angle of FIG. 8). Additionally, the lower hinges 118*a,b* may be connected to back sides 113*a,b* of earpieces via slots 126*a,b* defined in back sides 113*a,b*. that are sized and configured to receive protrusions 198*a,b* of lower hinges 118*a,b*. The back sides 113*a,b* may be arms that are configured to hold speaker elements 1.15*a,b*. Speaker elements 115*a,b* may be connected to back sides 113*a,b* by a snap fit feature 129*a,b* of elements 115*a,b* which may be received by a corresponding receptacle 127*a,b* of back sides 113*a,b* (note, snap fit feature 129*a* and receptacle 127*b* are not visible from the viewing angle of FIG. 8).

Similar to headphone set 10, the speaker elements 115*a,b* of headphone set 110 may comprise acoustic transducers that convert electrical signals to acoustic energy. The speaker elements 115*a,b* of earpieces 112*a,b* may be on-ear, over-ear, or in-ear earpieces, multiple transducer earpieces, or any other suitable type of earpiece.

In various embodiments, each hinge 116*a,b*, 118*a,b* may also include an adjustment member 189*a,b*, 199*a,b* that is accessible to a user. As described in more detail, below, the adjustment member 189*a,b*, 199*a,b* may be actuated or moved by a user such that the unfolded position, or angular configuration of the hinges 116*a,b*, 118*a,b* may be preset and/or adjusted to provide a custom fit of the headphone set 110.

Figure 10:
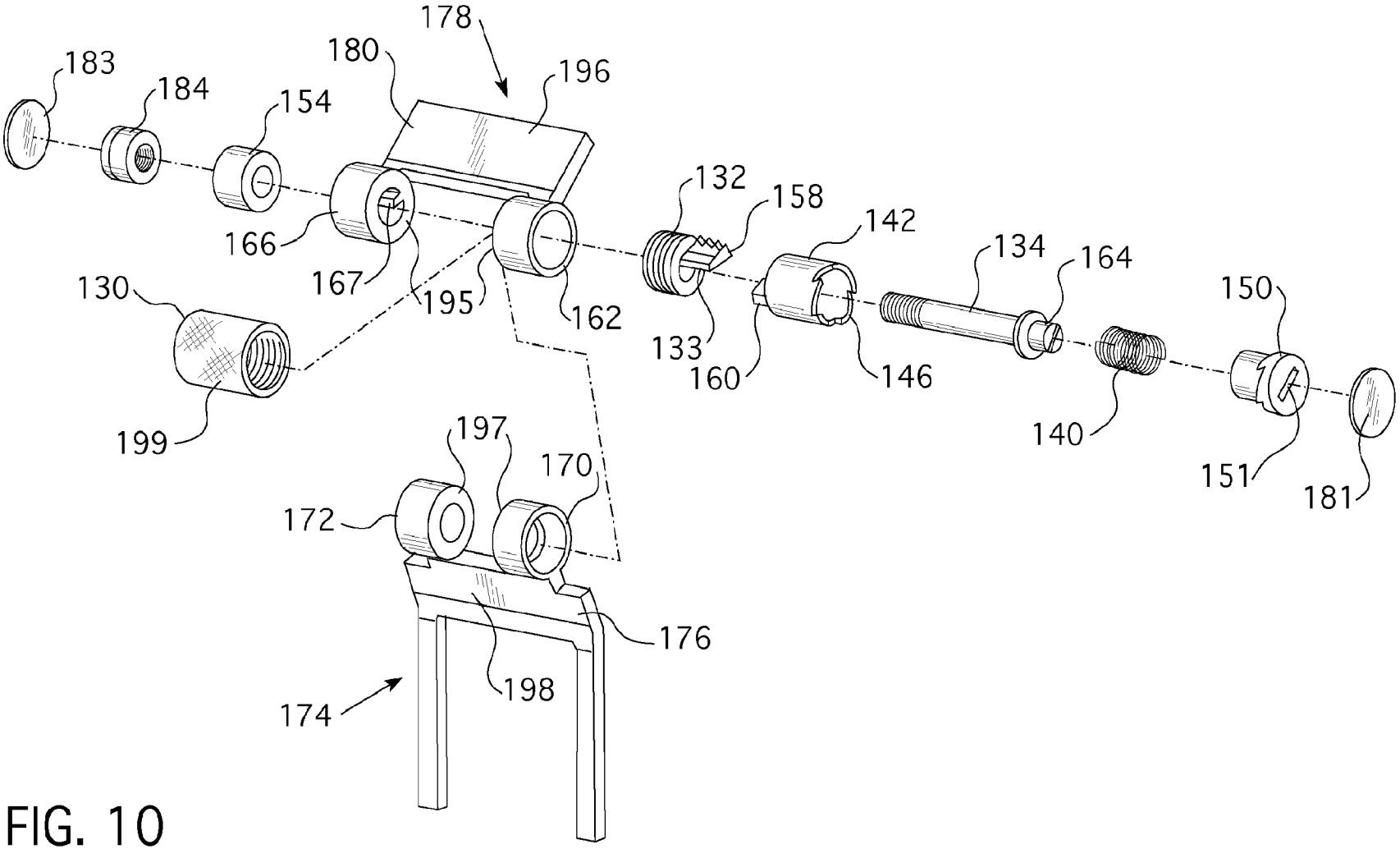
FIG. 10 is an exploded view of a hinge assembly of the headphone set of FIG. 7.

Focusing now on FIG. 10, an exploded view of one of lower hinges 118*a,b* is provided to illustrate the inner workings of one of the hinges. It will be appreciated that each of the hinges may be constructed and function in a similar fashion. In various embodiments, the aforementioned first rotatable member may be rotatable member 174, and the second rotatable member may be rotatable member 178. The first rotatable member 174 may include a first protrusion 198 extending from a first body 197. First body 197 may include rings 170, 172 connected to a first plate 176 of the first protrusion 198. The second rotatable member 178 may include a second protrusion 196 extending from a second body 195. Second body 195 may include end caps 162, 166 connected to a second plate 180 of the second protrusion 196. The first body 195 and second body 197 may define a rotation axis about which one or both of rotatable members 174, 178 may rotate with respect to each other. Accordingly, the first body 195 and the second body 197 may be rotatable with respect to each other between a first angle and a second angle defined between the first protrusion 198 and the second protrusion 196. Any reference portion of the protrusions 196, 198 may be used to define the angles as long as the same respective portions are used in determining the first and second angles.

Still referring to FIG. 10, a first wedge 160 may be defined at the left-hand side of an insert 142. The first wedge 160 may be fixedly connected to the first body 197, by, for example, an opening (not shown) formed within body 197. The opening may be shaped and configured to receive and engage the sides of wedge 160 while still allowing a portion of wedge 160 to pass therethrough. The wedge 160 may be also held axially in place by various components attached to the right-hand side of the insert 142. Accordingly, the first wedge 160 may be prevented from substantially rotating or translating with respect to the first rotatable member 174.

Referring again to FIG. 10, an axel 134 may be fixedly connected to the second body 195 by, for example, a key 167 defined within an opening of left end cap 166 which may engage a complimentarily-shaped groove (not shown) defined along at least a portion of the axial length of axel 134. A flange at the right-hand portion of axel 134 may be received within insert 142. Various components attached to the right of axel 134 may hold it axially in position. Accordingly, the axel 134 is prevented from substantially rotating or translating with respect to the second rotatable member 176.

Further, still focusing on FIG. 10, a stopper 132 may be slidably engaged with the axel 134. The stopper may also comprise a key 133 that is sized and configured to slidably engage the groove (not shown) defined along at least a portion of axel 134. The body key 167 and the stopper key 133 may be both designed to engage the same groove of the axel. Additionally, the stopper 132 may comprise a second wedge 158 defined at the right-hand side of the stopper 132. Accordingly, while the second wedge 158 may translate along the rotational axis of the axel 134, the wedge 158 is prevented from substantially rotating with respect to the axel 134, and, owing to the fixed connection between the axel and the second body 195, the second wedge 158 is also rotationally fixed with respect to the second body 195.

Referring still to FIG. 10, the hinge may also comprise an adjustment member 199 that is accessible to a user and operably connected to the stopper 132 such that movement of the adjustment member 199 relative to the stopper 132 causes the stopper 132 to translate along the rotational axis defined by the first body 195 and the second body 197. For example, in various embodiments, the adjustment member 199 may be a generally cylindrical knurled dial 130 that may be positioned between rings 170, 172. The dial 130 may include threads defined therein that are configured to engage threads defined on a surface of stopper 132. Accordingly, rotation of dial 132 in a first direction may translate the stopper 132 along the axel 134 in an axial direction. Likewise, rotation of the dial 132 in reverse direction may translate the stopper 132 along the axel 134

Referring again to FIG. 10, the first wedge 160 and the second wedge 158 are configured to engage each other when the first protrusion 198 and the second protrusion 196 define the second angle. Further, movement of the stopper 132 along the axel 134 may adjust the relative contact portion of each of first wedge 160 and second wedge 158. Owing to the shapes of first and second wedges 160, 158, when the wedges 160, 158 are engaged or contacting each other, the relative angular position of the first rotatable member 174 and the second rotatable member 178 may be adjusted accordingly by actuation of adjustment member 199. Therefore, movement of adjustment member 199 may change the second angle at which the first and second rotatable members 198, 196 are prevented from further rotating with respect to each other.

By way of example, in various embodiments, the hinge shown exploded in FIG. 10 may further comprise a torsional member 140 operably coupled between the axel 134 and the first wedge 160. While the axel 134 may be translationally fixed to insert 142, it may be permitted to rotate therein. At the right-hand portion of the axel 134, a torsional member 140, may be engaged to a slotted post 64 defined by axel 134. Torsional member 140 may be a helical spring, as illustrated, a spiral spring, and/or an elastomeric slug, for example. In any case, the left-hand portion of torsional member 140 may engage the slotted post 64 via a protrusion extending from torsional member 140. A torque dial 150 may be coupled to the right-hand portion of the torsional member 140 via a slot (not shown) formed in dial 150 and another protrusion extending from member 140. The dial 150 may include angled teeth that are complimentary to and designed to engage angled teeth 146 defined at the right-hand portion of insert 142. The angled teeth of torque dial 150 and the angled teeth 146 of insert 142 may function similar to a ratchet in that the torque dial 150 may be rotated, via a tool slot 151 defined therein, in a direction that follows the angled slope of the aforementioned teeth. Rotation of the torque dial 150 may allow one to adjust the amount of torque that may be applied by the torsional member 140 between the axel 134 and the torque dial 150. Ultimately, after adjusting the torque dial 150, a hinge cap 181 may be attached to end cap 162 thereby securing the right-hand side of the hinge. Also, because the torque dial 150 is thereafter fixed to the insert 142, which is also fixed with first rotatable member 174, and the axel 134 is rotationally fixed to stopper 132, which is rotationally fixed with second rotatable member 178, the torsional member 140 may apply a torque between first and second rotatable members 174, 178.

Also, still focusing on FIG. 10, in various embodiments, the hinge may further comprise a damper 154 operably engaged with the axel 134 and the first body 195 to provide a slow controlled opening or closing of the hinge when the torsional member 140 applies torque such that the first and second rotatable member 174, 178 rotate with respect to each other, as described above. The damper 154 may be a friction grommet and may be positioned within left ring 172 of the first body 197. The axel 134 may insert through the damper 154 and into left end cap 166. A retaining nut may be screwed onto threads defined at the left-hand portion of axel 134 such that axel 134 is held at least partially within left end cap 166. A hinge cap 183 may close the hinge at left end cap 166. The outer surface of damper 154 may be configured to apply a friction force between the damper 154 and the inner surface of the left ring 172. Likewise the inner surface of damper 154 may be configured to apply a friction force between the damper 154 and an outer surface of the axel 134. In other words, the damper 154 may be sized and configured such that there is a rubbing contact between the damper 154 and the left ring 172 and/or between the damper 154 and the axel 134. Accordingly, rotation of the axel 134 with respect to the first body 197 may cause the damper 154 to create a friction force between the damper 154 and the left ring 172 and/or the axel 134. While the damper 154 has been illustrated as a friction grommet, other dampers may be possible, such as a dashpot, for example.

The examples presented herein are intended to illustrate potential and specific implementations of the embodiments. It can be appreciated that the examples are intended primarily for purposes of illustration for those skilled in the art. No particular aspect or aspects of the examples is/are intended to limit the scope of the described embodiments.

It is to be understood that the figures and descriptions of the embodiments have been simplified to illustrate elements that are relevant for a clear understanding of the embodiments. Because such elements are well known in the art and because they do not facilitate a better understanding of the embodiments, a discussion of such elements is not provided herein.

While various embodiments have been described herein, it should be apparent that various modifications, alterations, and adaptations to those embodiments may occur to persons skilled in the art with attainment of at least some of the advantages. For example, the headphone unit may comprise, just one earpiece. The headphone unit may, in such embodiments, also comprise a microphone. Also, in various embodiments, the headphone unit may be wired or wireless. Further, in various embodiments, the headphone may comprise one or more hinges, one or more of which may be adjustable and/or spring-loaded. The disclosed embodiments are intended to include all such modifications, alterations, and adaptations without departing from the scope of the embodiments as set forth herein.

Any patent, publication, or other disclosure material, in whole or in part, that is said to be incorporated by reference herein is incorporated herein only to the extent that the incorporated material does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

What is claimed is:

1. A headphone unit, comprising:

a foldable headband including:

a first arm;

a second arm;

a hinge connecting the first arm to the second arm, wherein the first arm and the second arm are rotatable between a first angle and a second angle defined between the first arm and the second arm, wherein the hinge comprises an adjustment member configured to adjust the second angle, wherein the hinge comprises a torsional member; and a magnetic latch operably coupled to the first arm, wherein the magnetic latch comprises at least one magnet; and at least one earpiece connected to the foldable headband;

wherein the first arm, the second arm, the hinge, and/or the at least one earpiece comprise a magnetic material that is attracted to the at least one magnet such that the magnetic latch releasably holds the first arm and the second arm when the first arm and the second arm define the first angle.

2. The headphone unit of claim 1, wherein the foldable headband further comprises a second hinge connecting the earpiece to the second arm, wherein the second arm and the earpiece are rotatable between a third angle and a fourth angle defined between the second arm and the earpiece, wherein the second hinge comprises a second adjustment member configured to adjust the fourth angle, wherein the second hinge comprises a second torsional member.

3. The headphone unit of claim 1, wherein the hinge comprises a damper.

4. The headphone unit of claim 1, wherein the hinge further comprises:

a first rotatable member connected to the first arm;

a first wedge fixedly connected to the first rotatable member;

a second rotatable member connected to the second arm, wherein the first rotatable member and the second rotatable member define a rotation axis, wherein the first rotatable member and the second rotatable member are rotatable with respect to each other between the first angle and the second angle;

an axel fixedly connected to the second rotatable member;

a stopper slidably engaged with the axel, wherein the stopper comprises a second wedge;

an adjustment member that is accessible to a user and operably connected to the stopper such that movement of the adjustment member relative to the stopper causes the stopper to translate along the axel, wherein the first wedge and the second wedge are configured to engage each other when the first arm and the second arm define the second angle.

5. The headphone unit of claim 4, further comprising a torsional member operably coupled between the axel and the first wedge.

6. The headphone unit of claim 4, further comprising a damper operably engaged with the axel and the first body.

7. The headphone unit of claim 4, wherein the adjustment member comprises a cylindrical dial defining dial threads therein, wherein the stopper further comprises stopper threads defined thereon, and wherein the dial threads are configured to engage the stopper threads such that rotation of the cylindrical dial with respect to the stopper causes the stopper to translate along the axel.

8. A headphone unit, comprising:

a foldable headband including:

a first arm;

a second arm;

a hinge connecting the first arm to the second arm, wherein the first arm and the second arm are rotatable between a first angle and a second angle defined between the first arm and the second arm; and a magnetic latch operably coupled to the first arm, wherein the magnetic latch comprises at least one magnet; and at least one earpiece connected to the foldable headband;

wherein the first arm, the second arm, the hinge, and/or the at least one earpiece comprise a magnetic material that is attracted to the at least one magnet such that the magnetic latch releasably holds the first arm and the second arm when the first arm and the second arm define the first angle.

9. The headphone unit of claim 8, wherein the at least one magnet creates a magnetic field, wherein the magnetic latch is deformable to alter the orientation of the magnetic field produced by the at least one magnet such that the attraction between the at least one magnet and the magnetic material is decreased.

10. The headphone unit of claim 8, wherein the magnetic latch includes a body, a movable member slidably contained within the body, a resilient member engaged with a portion of the movable member and with a portion of the body, a clutch assembly operably coupled between the movable member and the body, and a user-accessible control member operably engaged with the clutch assembly, wherein the movable member is connected to the first arm, wherein the control member is configured to release the clutch assembly, when actuated by a user, such that the resilient member moves the movable member which moves the first arm relative to the body such that the magnetic material is moved away from the magnet.

11. The headphone unit of claim 8, wherein the foldable headband further comprises a second hinge connecting the earpiece to the second arm, wherein the second arm and the earpiece are rotatable between a third angle and a fourth angle defined between the second arm and the earpiece.

* * * * *